US005234173A

United States Patent [19]

Nishikawa et al.

[11] Patent Number: 5,234,173

[45] Date of Patent: Aug. 10, 1993

[54] SPUN YARN WINDING MACHINE

[75] Inventors: Hisao Nishikawa; Kiyotsune Higuchi, both of Kyoto; Yutaka Okimura, Osaka, all of Japan

[73] Assignee: Murata Kikai Kabushiki Kaisha, Kyoto, Japan

[21] Appl. No.: 766,820

[22] Filed: Sep. 26, 1991

[30] Foreign Application Priority Data

Oct. 5, 1990 [JP] Japan ..... 2-269241
Jul. 24, 1991 [JP] Japan ..... 3-65851[U]

[51] Int. Cl.[5] ..... B65H 67/048

[52] U.S. Cl. ..... 242/18 A; 242/25 A; 242/56 A

[58] Field of Search ..... 242/18 A, 25 A, 56 A, 242/18 R, 18 DD, 25 R, 65, 66

[56] References Cited

U.S. PATENT DOCUMENTS 2,082,031 6/1937 Schultz et al. ..... 242/56 A X
3,090,569 5/1963 Beushausen ..... 242/25 A X
3,607,566 9/1971 Medney et al. ..... 242/18 A X
5,012,985 5/1991 Pepe ..... 242/25 A

*Primary Examiner*—Stanley N. Gilreath
*Attorney, Agent, or Firm*—Spensley Horn Jubas & Lubitz

[57] ABSTRACT

The present invention provides a spun yarn winding machine which enables the double support of bobbin holders including the time when yarn is switched and capable of lengthening the bobbin holders.

A spun yarn winding machine in which two bobbin holders rotated and driven are projected on a turnable turret plate and, the bobbin holders are positioned alternately at a winding position and at a standby position, respectively, includes an extreme end support device for supporting extreme ends of the bobbin holders and at the winding position and at the standby position and capable of opening the extreme end of the bobbin holder at the standby position.

12 Claims, 11 Drawing Sheets

SPUN YARN WINDING MACHINE

FIELD OF THE INVENTION

The present invention relates to a spun yarn winding machine for winding yarns spun out of a spinning machine at high speeds, and more particularly to a turret type spun yarn winding machine wherein bobbin holders projected on a turret plate are turned when a yarn is switched.

PRIOR ART

A conventional spun yarn winding machine of this kind will be described with reference to FIG. 10 (a side view), FIG. 11 (a front view), and FIG. 12. The spun yarn winding machine 101 principally comprises a turret plate 104 which turns by 180° around a horizontal shaft 103 with respect to a body frame 102, two bobbin holders 105 and 106 projected in a cantilever fashion from the turret plate 104, induction motors 107 and 108 fixed on the back side of the turret plate 104 to rotate and drive the bobbin holders 105 and 106, a touch roller 110 provided on an elevating frame 109 which is movable up and down vertically with respect to the body frame 102, and a traverse device 111 provided on an elevating frame 109. The elevating frame 109 is supported in load by a contact pressure cylinder 112 provided on the base end side of the elevating frame 106. A difference pressure force between the whole weight of the elevating member and the raising force imparted by the contact pressure cylinder 112 defines a contact pressure force with respect to a package of a touch roller 110. Reference character B designates a bobbin; P, a package wound about the bobbin B; and 113, a pusher device for pushing out the bobbin B of the full package P.

The operation of the aforementioned spun yarn winding machine will be described hereinafter.

In FIG. 10, the bobbin holder 105 is at a winding position a, and the bobbin holder 106 is at a standby position b. When the package at the winding position a is full, the turret plate 104 turns through 180°, and the full package P assumes the standby position and the empty bobbin B assumes the winding position. As shown in FIG. 11, yarn Y is wound on the full package P while contacting the bobbin B, and the yarn Y is transferred from the full package P to the bobbin B by a yarn delivery device not shown. Next, the rotation of the bobbin holder 106 at the standby position is stopped, and the full package P is pushed to a doffere car not shown and at the same time an empty bobbin B is inserted into the bobbin holder 106. The above-described operation is repeated to continuously wind the yarn.

The above-described conventional bobbin holders 105 and 106 are cantilever rotary bodies and hold the package P having a considerable weight wound on the bobbin B, and a predetermined contact pressure is imposed through the touch roller 110. An example of construction of the bobbin holders 106 and 106 will be described with reference to FIG. 12. The bobbin holders 105 and 106 include a fixed cylinder 122, a drive shaft 123 and a rotary cylinder 124. The rotary cylinder 124 constitutes a fundamental member for holding the bobbin B and is fixed to the extreme end of the drive shaft 123 by a rib 124A within the rotary cylinder 124. This drive shaft 123 is supported by a bearing 126 within the fixed cylinder 122 inserted into the rotary cylinder 124. Induction motors 107 and 108 are mounted on the end of the drive shaft 123. As just mentioned, the rotary cylinder 124 is designed so that it is supported by the fixed cylinder 122 through the induction motors 107 and 108. Next, the holding structure of the bobbin B will be described. A spacer ring 129 and a resilient ring 130 are alternately loosely fitted in the outer periphery of the rotary cylinder 124. The spacer ring 129 is a cylinder formed of aluminum to support the inside diameter of the bobbin B by the outer periphery thereof. The resilient ring 130 is a rubber ring having a substantially square section with metal plates adhered to both ends thereof, and when the resilient ring 130 receives an axial compressive force through the spacer ring 129, the inside and outside diameters thereof expand. The expansion deformation of the inside and outside diameters causes the resilient ring 130 to be placed in close contact with the outer periphery of the rotary cylinder 124 and the inner periphery of the bobbin to coaxially hold the bobbin B on the rotary cylinder 124 to transmit a rotational drive force. A cap 131 is movably inserted into the extreme end of the rotary cylinder 124, and the resilient ring 130 is compressed or released by the cap 131. Further, a piston 131A of this cap and a cylinder 124B at the extreme end of the rotary cylinder constitute an actuator. Normally, a spring 132 is interposed between the piston 131A and the cylinder 124B, and the cap 131 compresses the resilient ring 130 through the spacer ring 129 to hold the bobbin B. When compressed air is introduced from an air hole 123A which extends through the center of the drive shaft 123 into a right chamber of the piston 131A, the piston 131A moves leftward to release the resilient ring 130 and release the bobbin B, too. In the bobbin holder having the construction described. above, the rotary cylinder 124 is supported in a cantilever fashion with a point A as a fixed fulcrum with respect to the drive shaft 123.

The bobbin holders 105 and 106 are cantilevered rotating bodies and hold the package P having a considerable weight wound on the bobbin B, and a predetermined contact pressure is imposed through the touch roller 110. Recent spun yarn winding machines ordinarily employ high-speed winding at 3000 m/min. or more. The bobbin holders 105 and 106 have been gradually increased in length to 1200 mm. The bobbin holder of even greater length, up to 1600 mm have been studied. However, for those having a length of 1600 mm, the cantilever bobbin holders explained in connection with FIGS. 10, 11 and 12 are difficult to realize it in terms of construction. In view of this, it has been proposed that a bobbin holder at a winding position is designed to be double-supported, and when a yarn is switched, the bobbin is used in a cantilever mode, and the turret plate is turned. However, the bobbin holders are rotating at high speeds even when a yarn is switched, and problems such as vibrations or the like resulting from unreasonableness of construction due to the trend toward longer bobbin holders occur when the yarn is switched. As a result, there mechanical life is reduced due to an increase in mechanical vibrations, falling in end of a full package and promotion of wrinkle winding, i.e. the damage of an inner layer of yarn due to the transmission of vibrations to the bobbin holder at the winding positions, etc.

SUMMARY OF THE INVENTION

The present invention has been achieved in view of problems noted above with respect to the prior art. An object of the present invention is to provide a spun yarn winding machine which enables double-support for a bobbin holder including the time at which a yarn is switched, thus enabling the use of bobbin holders which are lengthy.

For achieving the aforesaid object, one embodiment of the present invention provides a spun yarn winding machine in which two bobbin holders which may be rotated and driven are projected on a turnable turret plate. The bobbin holders may be positioned alternately at a winding position and at a standby position, respectively. A first arm for supporting extreme ends of the bobbin holders may be provided turnably coaxially to the turret plate, and a second arm for supporting the first arm and for pivoting the first arm about the winding position may be provided on the frame side of the body.

The first arm provides double-support state during the switching of the yarn as it turnably supports an extreme end of the bobbin holders. When the full package stops at the standby position, the second arm causes the first arm to be oscillated about the winding position, and therefore, the first arm moves to a position which constitutes no obstacle to the extrusion of the full package while the bobbin holder at the winding position remains double-supported.

Another embodiment of the present invention provides a spun yarn winding machine in which two bobbin holders that may be rotated and driven are projected onto a turnable turret plate. The bobbin holders may be positioned alternately at a winding position and a standby position, respectively. The winding machine may include an extreme end support device for supporting extreme ends of the bobbin holders at the winding position and at the standby position, which and is capable of opening the extreme end of the bobbin holder at the standby position. The winding machine may also include chuck means for grasping a root outer diameter portion of the bobbin holder at the standby position.

DETAILED DESCRIPTION OF PREFERRED EMBODIMENTS

Embodiments of the present invention will be described hereinafter with reference to the drawings.

Figure 1:
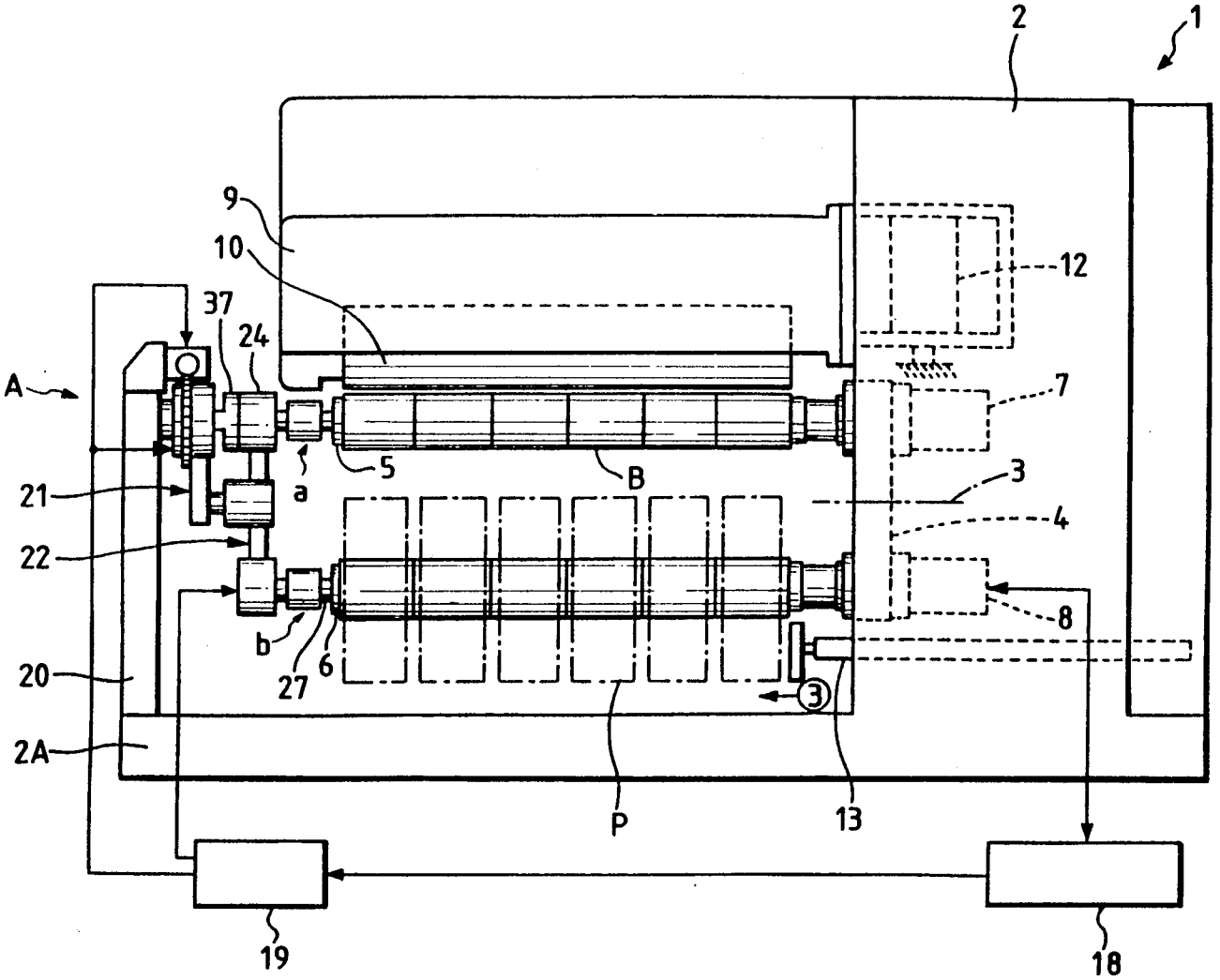
FIG. 1 is a side view of a spun yarn winding machine in accordance with one embodiment of the present invention.
Figure 2:
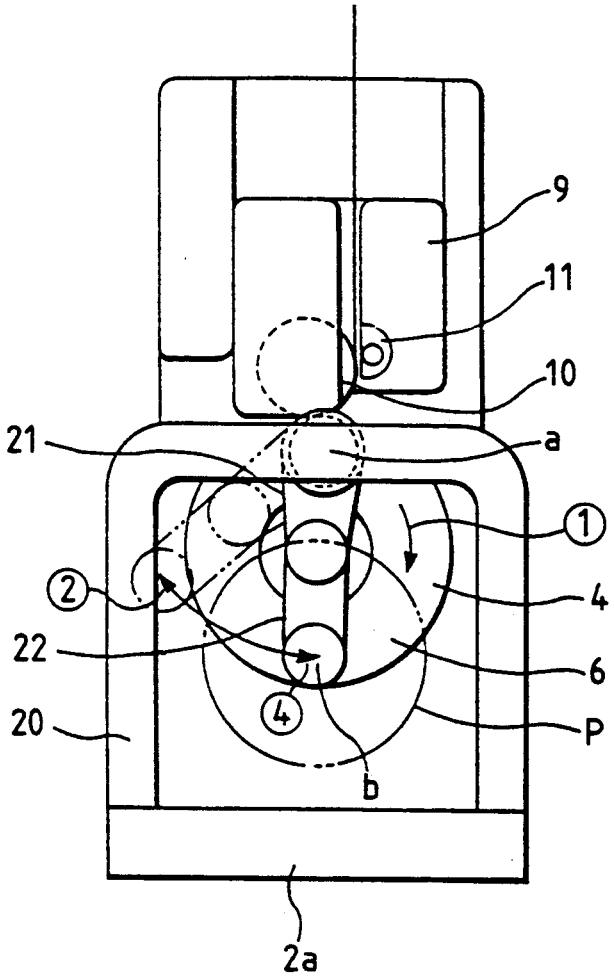
FIG. 2 is a front view of a spun yarn winding machine in accordance with the embodiment illustrated in FIG. 1.

FIG. 1 is a side view of a spun yarn winding machine according to a first embodiment of the present invention, and FIG. 2 is a front view of the spun yarn winding machine illustrated in FIG. 1. In FIGS. 1 and 2, the reference numeral 1 designates a spun yarn winding machine; 2, a body frame; 4, a turret plate; 5, 6 bobbin holders; 7, 8, induction motors; 9, an elevating frame; 10, a touch roller; 11, a traverse device of a blade type; 12, a contact pressure cylinder; and 13, a pusher device.

One aspect of the present invention which differs from the conventional device is the support construction for the extreme ends, i.e., the ends opposite those ends mounted on the turret plate of bobbin holders 5 and 6. The support construction will now be described in detail.

In FIGS. 1 and 2, a gate-type frame 20 is erected on the end 2A of the bottom of a body frame. A second arm 21 is pivotably supported on the gate-type frame 20, and a first arm 22 is rotatably supported on the second arm.

The detail of the construction of the first arm 22 and the second arm 21 will be described in details with reference to FIGS. 3 and 4.

The first arm 22 has a bearing box 23 at the center thereof, and a cylinder 24 at an equal distance on both ends thereof. A piston 25 is slidably inserted within the cylinder 24. A cone 26 is inserted under pressure into the piston 25, and a support shaft 27 is rotatably supported within cone 26 by means of a bearing 28. One end of the support shaft 27 is conical, which engages a conical hole 6*a* of a bobbin holder 6. The aforementioned cylinder 24 and the piston 25 constitute a pneumatic actuator so that when compressed air is introduced into a port c, the piston 25 retreats to release an engagement between the bobbin holder 6 and the support shaft 27. When compressed air is introduced into a port d, the piston 25 moves forward to bring the bobbin holder 6 into engagement with the support shaft 27. As described above, the support shaft 27 is turnable with respect to the bobbin holder and can be engaged and disengaged therefrom. The turning center of the first arm 22 is in coaxial with a horizontal shaft 3 shown in FIG. 1.

The second arm 21 has at one end a shaft 30 fitted into a bearing box 23 of the first arm 22 through a bearing 29 and at the other end a bearing box 31. The bearing box 31 is pivotably supported through a bearing 33 pressed into a cylinder 32 fixedly mounted on the gate-type frame 20. A pinion 34 is pressed in the outer periphery of the bearing box 31 in order to control a pivot angle of the second arm 21, and a rack 36 mounted on a cylinder device 35 is meshed with the pinion 34. The second arm 21 is pivotably supported on the gate-type frame 20 which is continuous to the end 2A of the bottom of the body frame, and the first arm 22 is rotatably supported on the second arm 21. The turning center of the second arm 21 is in coaxial with the bobbin holder 5.

Figure 3:
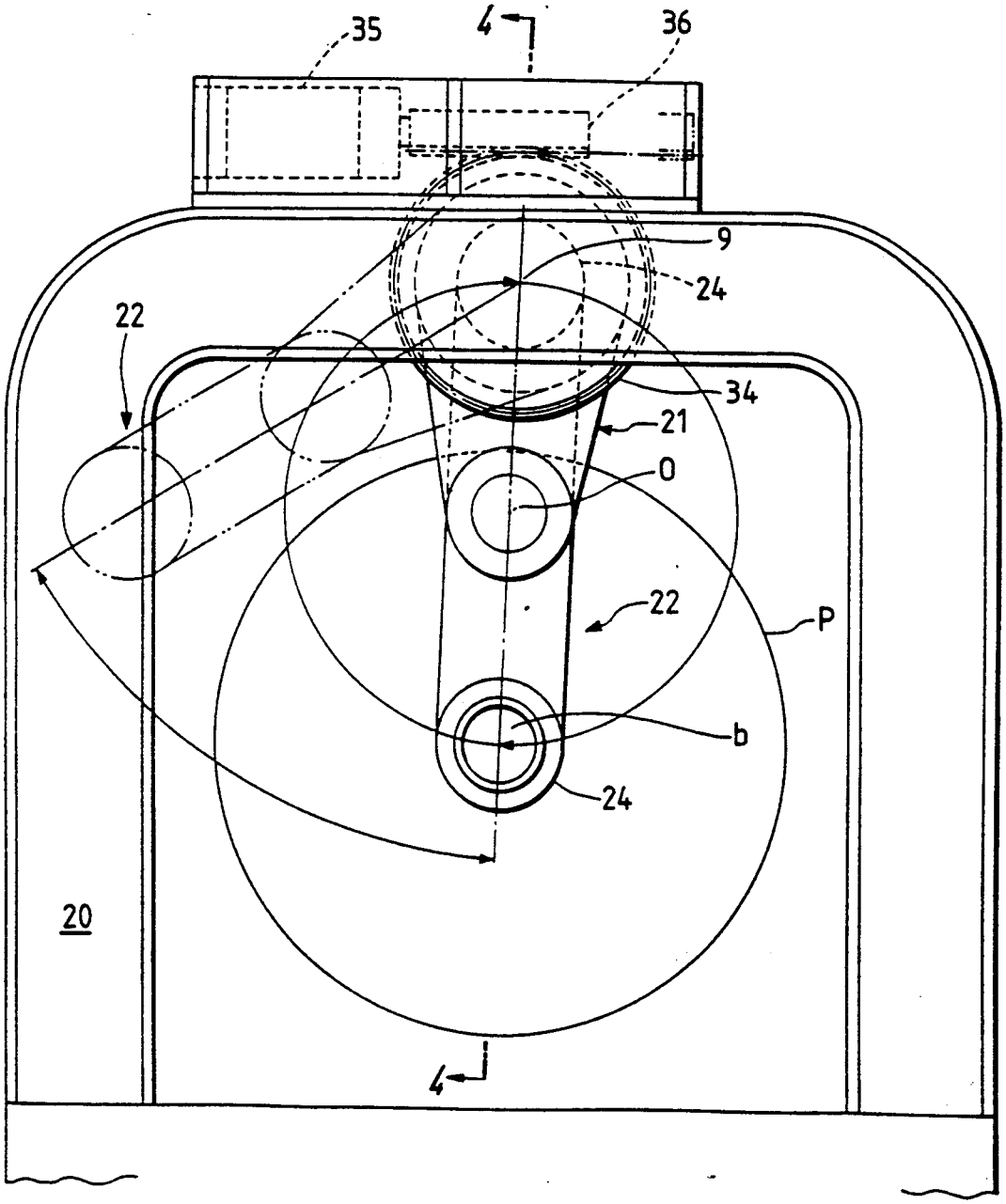
FIG. 3 is a front view of the embodiment illustrated in FIG. 1.
Figure 4:
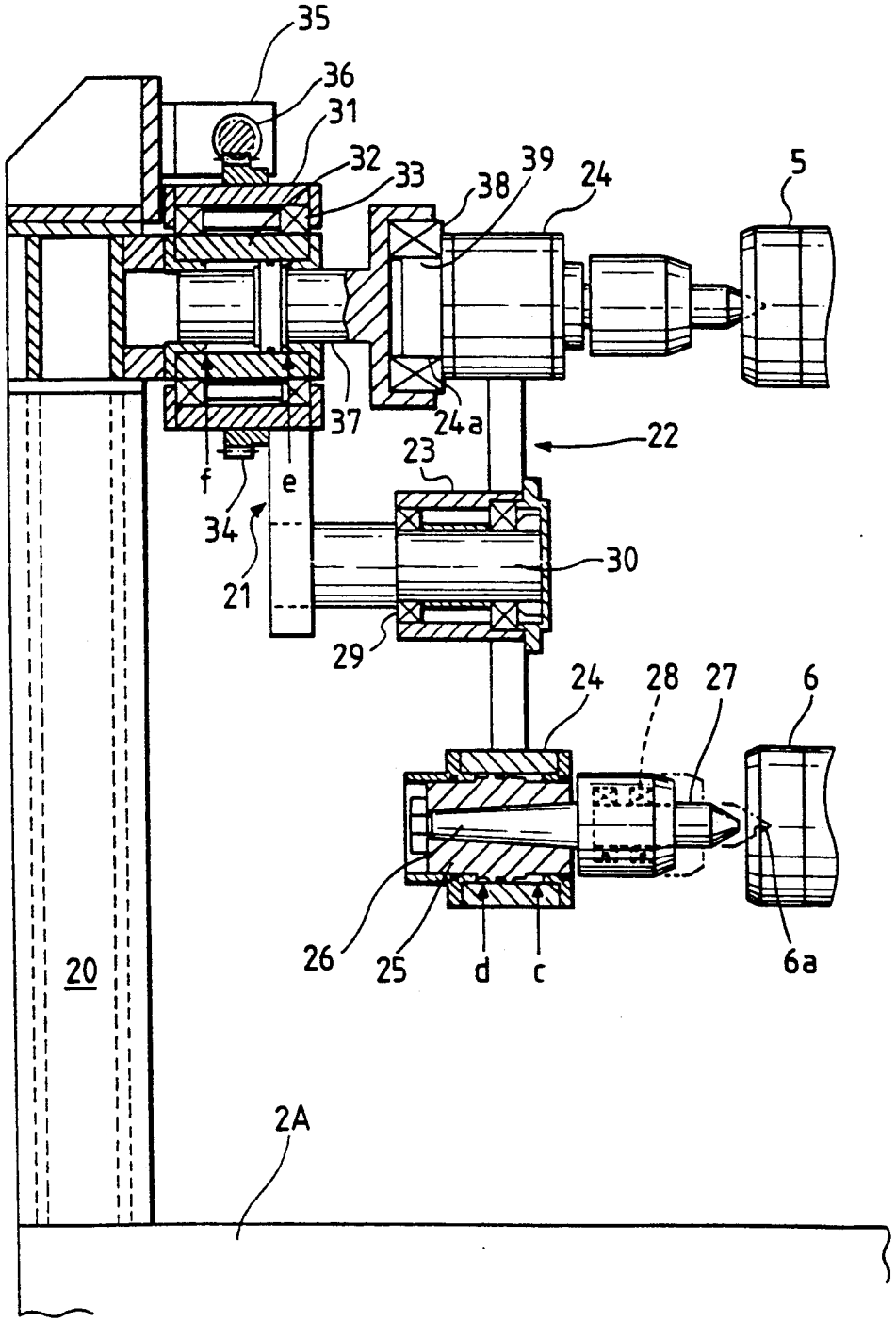
FIG. 4 is a sectional view taken on line 4—4 of FIG. 3.

As clearly shown in FIG. 3, one of the cylinders 24 of the first arm 22 is positioned at a winding position a while the other is positioned at a standby position b. The bearing box 23 of the first arm 22 is positioned at a turning center 0 of the turret plate. Accordingly, when the engagement between the bobbin holder at the standby position b and the first arm 22 is released to cause the cylinder device 35 to move forward, the second arm 21 is pivoted about the winding position a to a position indicated by the two-dotted chain lines. In this state, the first arm 22 and the second arm 21 assume a position free from interference with the extrusion of the full package P.

The bobbin holder which rotates at a high speed stays longer at the winding position, and the construction to enable the double-support of the bobbin holder 5 will be described with reference to FIG. 4. A piston 37 is slidably fitted into a cylinder 32 fixedly mounted on the gate-type frame 20. The piston is provided with an engaging hole 39 formed in a bearing 38 so that a small-diameter portion 24*a* at the rear of the cylinder 24 of the first arm 22 may be fitted into the engaging hole 39. The aforementioned cylinder 32 and the piston 37 constitute a pneumatic actuator so that when compressed air is introduced into a port e, the piston 37 retreats to release an engagement between the small diameter portion 24*a* and the engaging hole 39. When compressed air is introduced into a port f, the piston 37 moves forward to bring the small diameter portion 24*a* into engagement with the engaging hole 39. In this manner, the cylinder 24 of the first arm 22 at the winding position a is supported on a straight line of the gate-type frame 20 through the piston 37 and cylinder 32 of the second arm 21. Accordingly, the rigidity of the double-support of the bobbin holder 5 at the winding position a increases. It is to be noted that preferably, well known chuck means may be used in place of the bearing 38 at the extreme end of the piston 37. The chuck means can perform an accurate engagement maintaining a parallelism as compared with the case, for example, of a parallel hole or taper pin engagement.

The operation of the aforementioned spun yarn winding machine will be described with reference to FIGS. 1 and 2.

First, in FIGS. 1 and 2, when the full package is formed at the winding position a, the engagement between the cylinder 24 and the piston 37 is released so that the turret 4 turns (① operation), the full package P assumes the standby position b and the empty bobbin B assumes the winding position a into rolling contact with the touch roller 10 whereby a delivery of yarn from the full package P to the empty bobbin B is carried out. Simultaneously with the ① operation, the first arm 22 which double-supports the extreme ends of the bobbin holders 5 and 6 also turns about the horizontal shaft 3 (the engagement between the cylinder 24 and the piston 37 is being released). After completion of turning of the first arm 22, the cylinder 24 and the piston 37 again engage with each other and the bobbin holder 5 at the winding position a is positively double-supported. After completion of the yarn delivery, the induction motor 8 assumes a braked state, and the bobbin holder 6 at the standby position b is reduced in speed. Even in this reduced state, the bobbin holder 6 still remains double-supported. When the reduction state is completed to assume a stop state, the engagement between the support shaft 27 and the bobbin holder 6 is released (see the solid line state of FIG. 4). Next, the second arm 21 is oscillated about the winding position a in the direction of ②. That is, the first arm 22 and the second arm 21 retreat to a position indicated at two-dotted chain lines which constitutes no obstacle to the axial extrusion of the full package P. However, the double-support of the bobbin holder 5 at the winding position a remains maintained. Then, the full package P is extruded by the pusher device 13 to an automatic doffer or the like now shown (③ operation). Instead, when an empty bobbin B is inserted into the bobbin holder 6, the second arm 21 oscillates about the winding position a in the direction of ④, and the support shaft 27 and the bobbin holder 6 again engage with each other to ready for next yarn-switching.

In the operation described above, the bobbin holders 5 and 6 remain double-supported except during the extrusion of the full package P, and the double-support is maintained without fail during the high speed rotation of the bobbin holders 5 and 6. It is to be noted that control of timing of the operation of the actuator formed by a cylinder and a piston and the cylinder device is carried out by an electromagnetic valve device 19 which is actuated on the basis of a command of a controller 18 such as the induction motor 8.

While in the above-described embodiment, a description of a so-called spindle drive type winding machine in which the bobbin holders 5 and 6 on which the bobbin B is mounted are directly driven by the encased motor 8, it is to be noted that the above-described embodiment can be also applied to a so-called friction drive type winding machine in which a touch roller in rolling contact with the bobbin B mounted on the bobbin holders is driven to directly drive the bobbin B.

In the spun yarn winding machine according to the first embodiment of the present invention, the first arm for supporting the extreme ends of two bobbin holders may be rotatably mounted and coaxial with the turret plate, and the second arm for supporting the first arm and pivoting the first arm about the winding position is provided on the body frame side. The double-support state is maintained by the first arm even during switching a yarn, and when the full package stops at the standby position, the first arm assumes a position which constitutes no obstacle to the transfer of the full package with the aid of the second arm but the extreme end of the bobbin holders at the winding position remains double-supported. Therefore, the bobbin holders during the high speed rotation are always in the double-support state, making it possible to lengthen the bobbin holders. It is also possible to prevent falling of an end of the full package and promotion of a wrinkle winding resulting from an unreasonable cantilever of the bobbin holders, and to eliminate an adverse influence on an inner layer yarn due to the transmission of vibrations to the bobbin holder on the winding side.

A second embodiment of the present invention will be described with reference to FIGS. 5 and 6.

Figure 5:
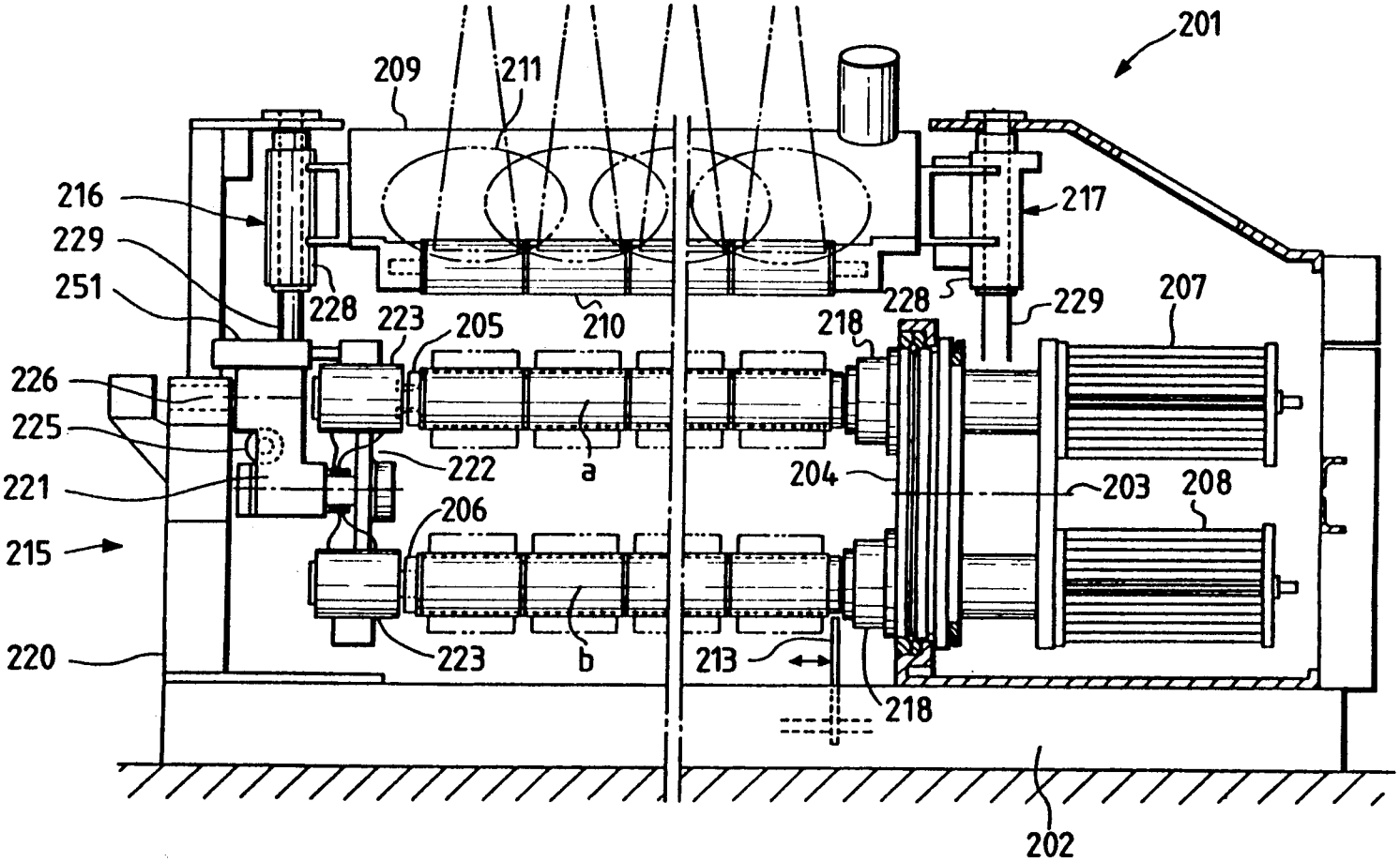
FIG. 5 is a side view of a spun yarn winding machine according to another embodiment of the present invention.
Figure 6:
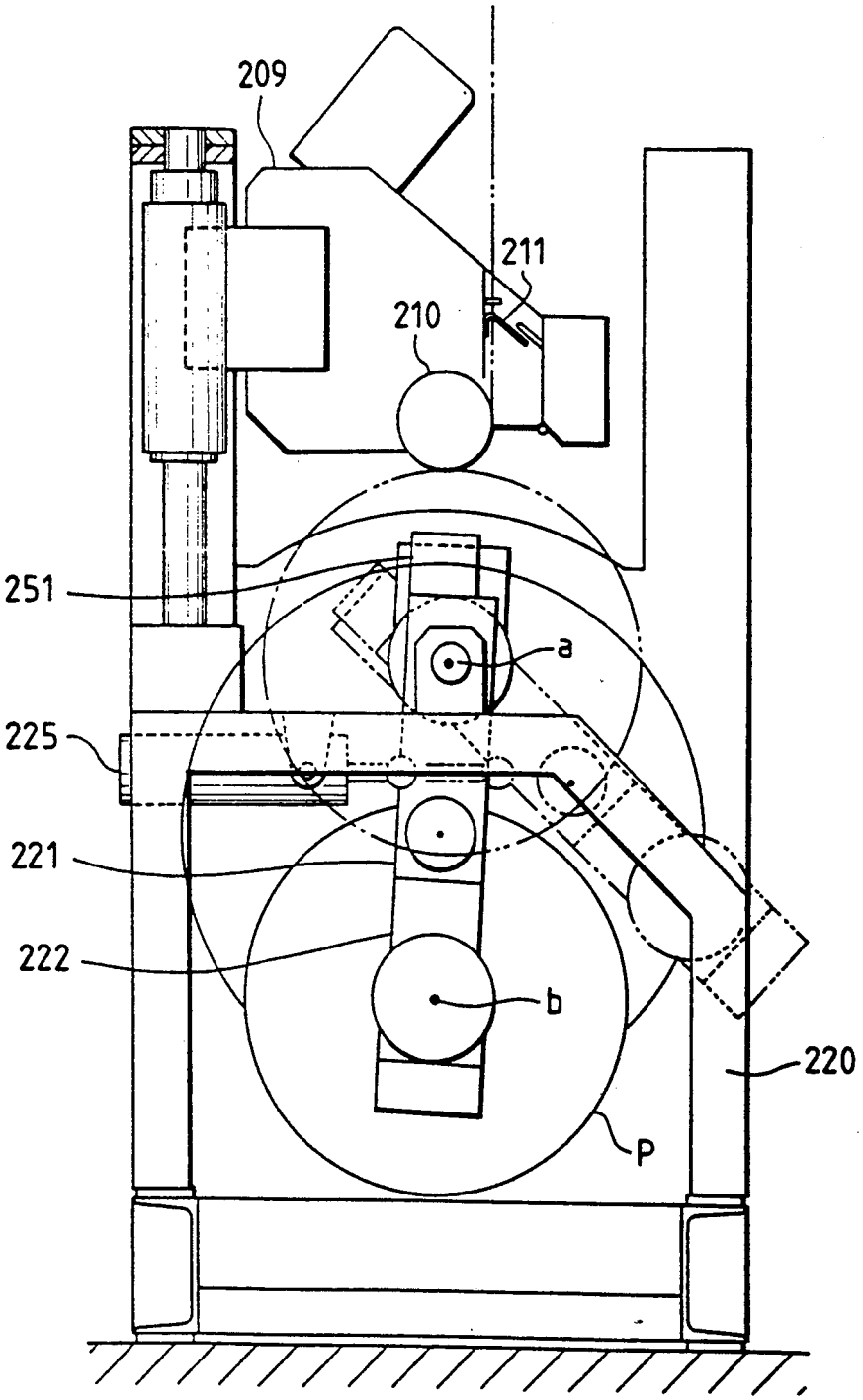
FIG. 6 is a front view of a spun yarn winding machine illustrated for example in FIG. 5.

In FIGS. 5 and 6, the reference numeral 201 designates a spun yarn winding machine; 202, a body frame; 204, a turret plate; 205, 206, bobbin holders; 207, 208, induction motors; 209, an elevating frame; 210, a touch roller; 211, a transverse device of a blade type; 213, a pusher device; 215, an extreme end support device; 216, 217, slide devices for the elevating frame 209; and 218, a chuck device for grasping a root outside diameter portion of the bobbin holders 205 and 206.

The extreme end support device 215, i.e. the device that supports the ends of the bobbin holders that are opposite the ends which are supported by the turret plate 204, may include an arm member 221 pivotably supported on a side frame 220 stood upright on the body frame 202, a turning member 222 rotatably supported on the arm member 221, a chuck device 223 on both ends of the turning member 222, and a stopper member 251 between the arm member 221 and the chuck device 223.

Figure 7A:
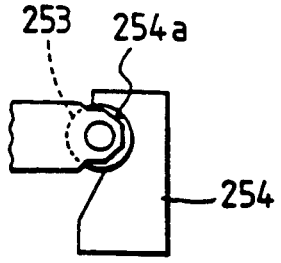
FIG. 7*a* is a top view of the end illustrated for example in FIG. 7.
Figure 7:
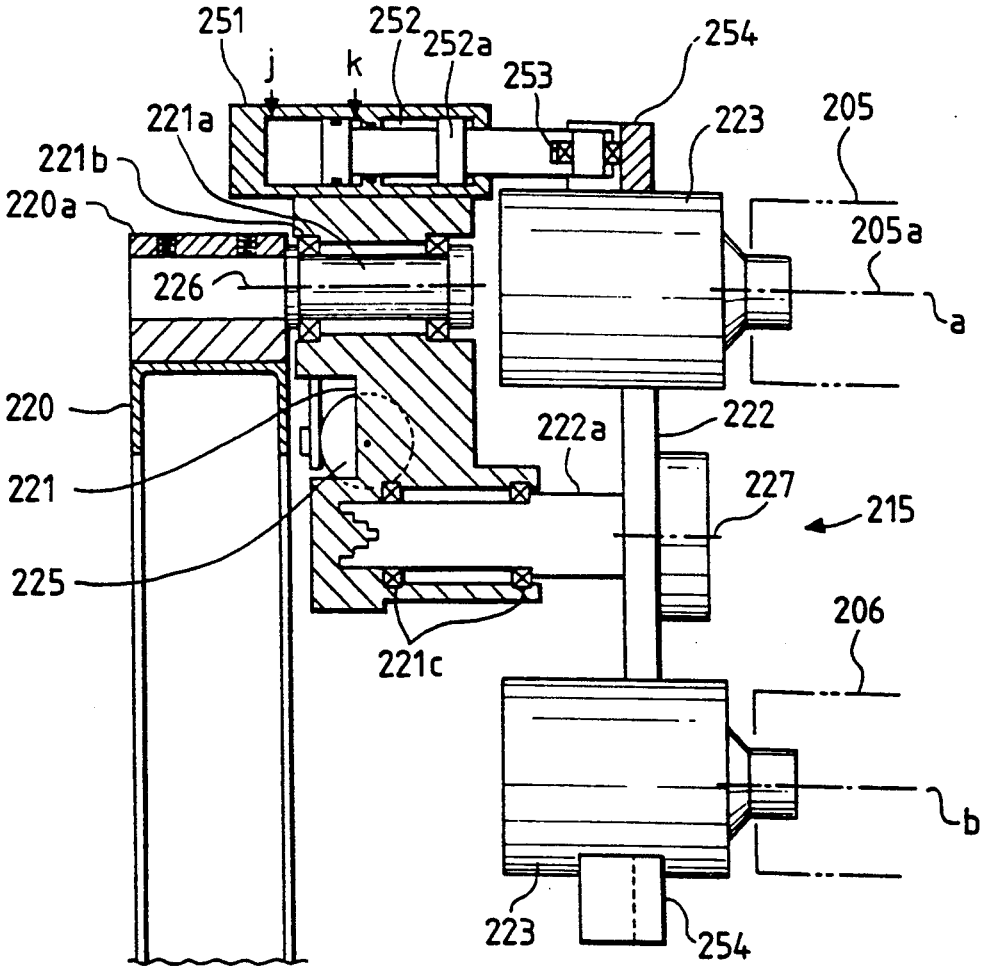
FIG. 7 is a sectional view of one end of a support device.

As illustrated for example in FIGS. 7 and 7*a*, the arm member 221 is may be pivotably supported by a shaft 221*a* fitted into a block 220*a* fixedly mounted on the side frame 220 and a bearing 221*b*. A bearing 221*c* is encased underside of the arm member 221, and a shaft 222*a* *T*of the turning member 222 is rotatably supported. The arm member 221 is pressed by a pneumatic cylinder 225 and the arm member 221 can be pivoted about a shaft 226 between a vertical position (solid line position) and an oblique position (two-dotted chain line) (see FIG. 6). This oscillating shaft 226 may be coaxial with a center shaft 205*a* of the bobbin holder 205, and when if the arm member 221 is pivoted, the center axis of the bobbin holder 205 during winding does not deviate. As shown in FIG. 6, when the arm member 221 is at an oblique position, it will not interfere with the full package P. When the arm member 221 is oscillated to the oblique position, a stopper member 251 (which will be described later) also oscillates with the arm member 221 and is not deviated in position from the bobbin holder at the winding position a.

In the second preferred embodiment, the turning member 221 may be rotatably supported at a shaft 222*a* on the arm member 221. Chuck devices 223 are mounted on opposite ends of the turning member 222 is disengageably support the extreme ends of the bobbin holders 205 and 206. The turning shaft 227 of the turning member 222 may be coaxial with the rotational shaft 204 of the turret plate 204 shown in FIG. 5 so that the turret plate 204 is rotated without trouble.

A stopper member 251 may include a roller 253 supported at the extreme end of a piston 252. The piston 252 is double-supported by a guide ring 252*a* and excels in an anti-lateral load. A receiving plate 254 is fixedly mounted on the chuck device 223, and the roller 253 moved out of the stopper member 241 is urged against a semicircular groove 254*a* of the receiving plate 254. The stopper member 251 may operate such that when the winding position a is switched from the standby position b (when the turret plate 204 in FIG. 5 is turned through 180°), pressurized air is introduced into a port k to release the roller 253 from the receiving plate 254 and the turning member 222 is rendered turnable. When the turning member 222 is completed to be turned, pressure air is introduced into a port j so that the roller 253 is urged against the receiving plate 254 and the bobbin holder 205 is located to a predetermined position of the winding position a. It is to be noted that locating means including a pin capable of being moved in and out is also provided on the turret plate 204 shown in FIG. 5, and therefore, locating after switching of the bobbin holders 205 and 206 is carried out at opposite ends so as to cope with the lengthening of the bobbin holders.

As illustrated for example in FIG. 5, slide devices 216 and 217 are provided to support both left and right ends of the elevating frame 209 which holds the touch roller 210. Tubular bodies 228 encasing a slide bearing encased therein are mounted on both left and right ends of the elevating frame 209. A guide rod 229 is stood upright on the body frame 202, and the tubular body 228 is guided to the guide rod 229. A predetermined contact pressure is applied to a package through the touch roller 210 by a contact pressure cylinder not shown.

The chuck device 218 may be designed to grasp a root outer diameter portion of the bobbin holder 206 which holds a full package at a standby position. A shown in FIG. 6, in removing the full package P, the arm member 221 and the turning member 222 are at the position indicated by two-dotted chain lines, and the bobbin holders in the stop state at the standby position are in the cantilever state, and therefore, the chuck devices grasp the root outer diameter portion of the bobbin holders to maintain the two-point support.

The operation of the second illustrated embodiment of the spun yarn winding machine will be described hereinafter with reference to FIGS. 5 and 6. When a full package is formed at the winding position a, the stopper member 251 assumes a release position, and at the same time the turret plate 204 turns, the turning member 222 also turns. Upon completion of the turning of the turret plate 204, the stopper member returns to an engaging position. Then, the full package P assumes a standby position b, and an empty bobbin B assumes a winding position b into rolling contact with the touch roller 210 to deliver a yarn from the full package P to the empty bobbin B. After completion of yarn delivery, the induction motor 208 assumes a braked state so that the bobbin holder 206 at the standby position b is reduced in speed. Even in the reduction state, the bobbin holder 206 remains double-supported. When the reduction is completed to assume a stop state, the engagement between the chuck device 223 and the extreme end of the bobbin holder 206, and at the same time, the chuck device 218 grasps the root outer diameter portion of the bobbin holder 206. Then, the arm member 221 oscillates about the oscillating shaft 226, and the arm member 221 and the turning member 222 retreat to a position indicated by two-dotted chain lines which constitutes no obstacle to the axial extrusion of the full package P (see FIG. 6). The full package P is pushed out to an automatic doffer or the like not shown by the pusher device 213. When an empty bobbin B is inserted into the bobbin holder 206, the arm member 221 oscillates and returns to a vertical orientation. The chuck device 223 and the bobbin holder 206 are again engaged with each other to prepare for next yarn switching. As described above, the bobbin holders 205 and 206 may remain double-supported or two-point supported during a series of operations including winding, yarn delivery, discharge of full package and insertion of empty bobbin, thereby rendering possible longer bobbin holders 205 and 206 and high speed rotation.

Since the elevating frame 209 is also double-supported by the slide devices 216 and 217, a parallelism between the touch roller 2190 and the bobbin holder 205 is maintained. That is, when the bobbin holder 205 is doubled-supported and the elevating frame 209 is cantilever supported, an unevenness of contact pressure caused by flexure of the elevating frame 209, i.e. the end of the touch roller 210 opposite the turret 204 side sags. However, by providing double-support for both the bobbin holder 205 and the elevating frame 209, the contact pressure becomes uniform. Accordingly, excessively rigid construction is not required for the double-supported elevating frame 209.

Figure 8A:
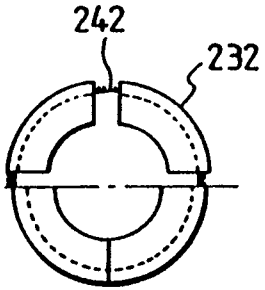
FIG. 8*a* is a front view of the device illustrated for example in FIG. 8.
Figure 8:
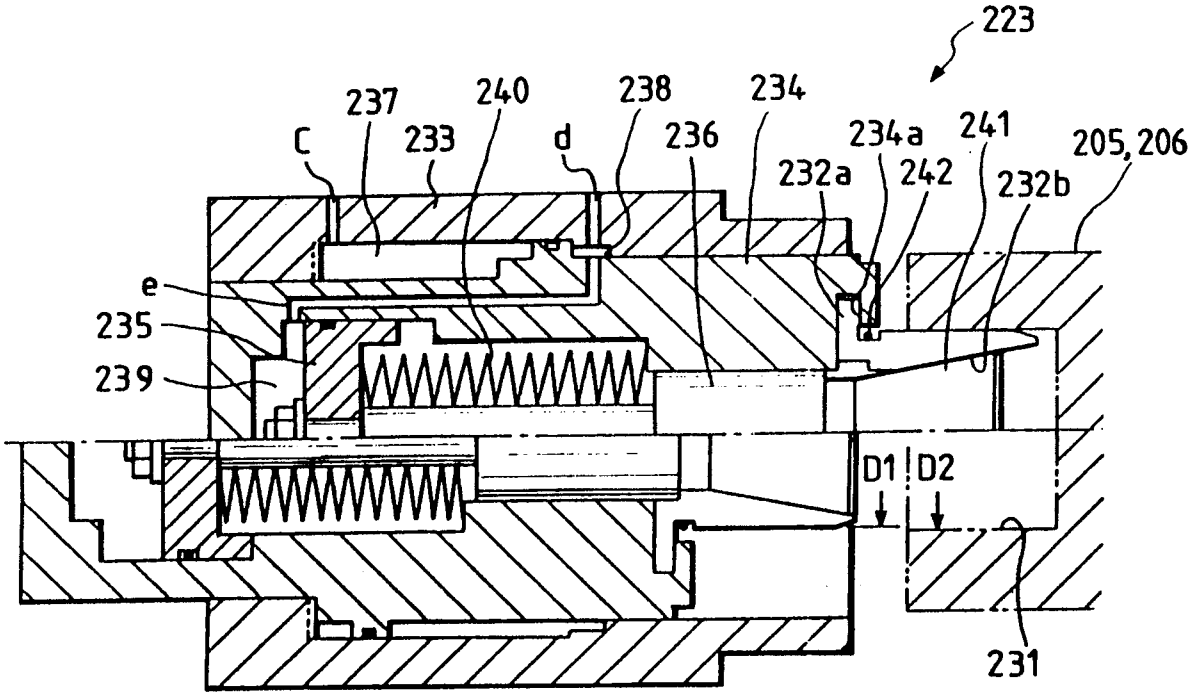
FIG. 8 is a sectional view of a chuck device in accordance with one embodiment of the present invention.
Figure 12:
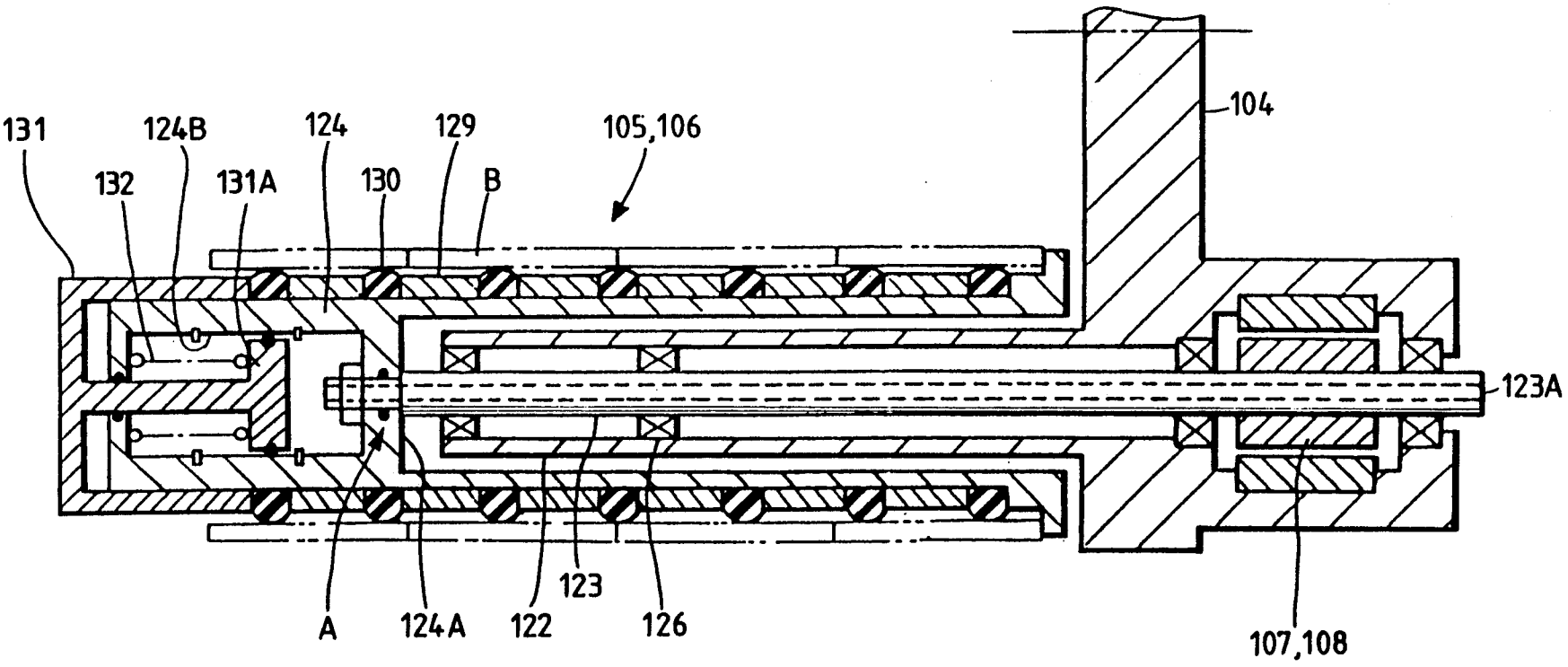
FIG. 12 PRIOR ART
FIG. 12 is a sectional view of a conventional bobbin holder.

Next, the construction and operation of one embodiment of the chuck devices 223 on opposite ends of the turning member 222 will be described with reference to FIGS. 8 and 8*a*. The upper portions of FIGS. 8 and 8*a* show the chucked state, and the lower portions of FIGS. 8 and 8*a* show the open state. An inner diameter portion 231 is provided at the extreme end of the bobbin holders 205 and 206, and the chuck device 223 has an expansible circumferential divisional ring 232 for internally grasping the inner diameter portion 231. That is, as explained in connection with FIG. 12, the bobbin holder is rotatably supported by the bearing, and when the chuck device is axially urged, an axial force is applied to the bearing. However, in the internal grasping chuck device 223 for the inner diameter portion 231, an axial force is not imparted to the bobbin holders 205 and 206 at the time of double-support.

One embodiment of the chuck device 223 may include a cylinder 233, a double-action piston 234, a single action piston 235, a shaft 236 with a cone, and a split ring 232. The cylinder 233 and the double action piston 234 forms a first air chamber 237 and a second air chamber 238. The pressure receiving area of the first air chamber 237 is larger than that of the second air chamber 238. The pressure receiving area of the first air chamber 237 is larger than that of the second air chamber 238. A port c is opened to the first air chamber 237, and a port d is opened to the second air chamber 238. A third air chamber 239 is formed between the double action piston 234 and single action piston 235, and a port e in communication with the port d is opened to the third air chamber 239. This single action piston 235 is urged leftward in the figure by means of a plate spring 240, and when pressure air is introduced into the third air chamber 239, the single action piston 235 moves rightward in the figure. The shaft 235 is connected to the single action piston 235, and has a cone 241 at the extreme end thereof. A flange portion 232*a* of the split ring 232 engages a groove 234*a* of the double action piston 234, and a conical inner diameter portion 232*a* of the split ring 232 embraces an outer diameter portion of the cone 241. The spring ring 232 is urged in a direction of reduced diameter by means of a spring 242.

The operation of the previously described embodiment of chuck device 223 will be described hereinafter. First, the state in which the underside of FIG. 5 is open will be described. When pressure air is introduced from the port d into the second air chamber 238, the double action piston 234 moves leftward in the figure. Pressure air is introduced into the third air chamber 239 by the port e in communication with the port d, and the single action piston 235 moves rightward in the figure overcoming the bias of the plate spring 240. Since the cone 241 also moves rightward in the figure, the outer diameter D1 of the split ring 232 becomes smaller than the inner diameter D2 of the inner diameter portion 231. The split ring 232 itself is received into the cylinder 233. Next, the chucking state in the upper side of FIG. 8 will be described. Pressure air is introduced from the port c into the first air chamber 237. In this case, pressure air remains introduced into the second air chamber 238 and the third air chamber 239 but the pressure receiving area of the first air chamber 237 is larger than that of the second air chamber 238, and as a result, the double action piston 234 moves leftward in the figure. However, the single action piston 235 remains moved rightward in the figure overcoming the bias of the plate spring 240. For this reason, the split ring 232 is inserted into the inner diameter portion 231 while maintaining the small outer diameter D1. When the introduction of pressure air to the port d is disconnected, the single action piston 235 is moved leftward in the figure by the bias of the plate spring 240, and the split ring 232 is increased in diameter to internally grasp the inner diameter portion 231 of the bobbin holders 205 and 206.

Figure 9:
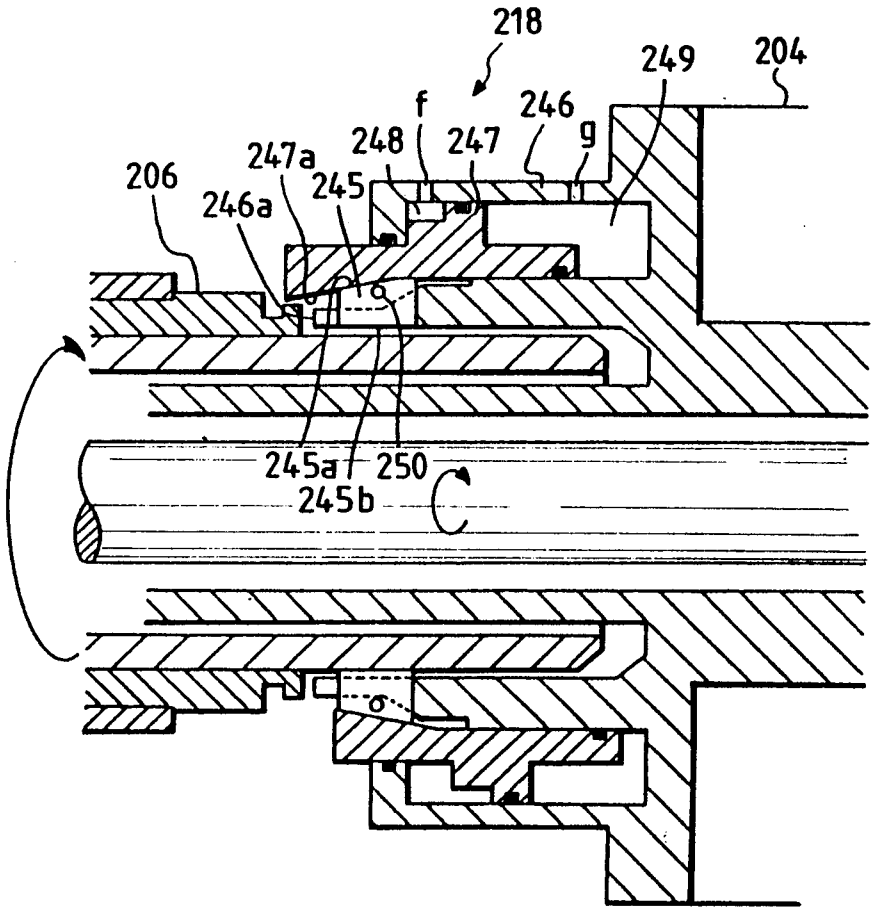
FIG. 9 is a sectional view of a chuck device for the root of a bobbin holder.
Figure 9A:
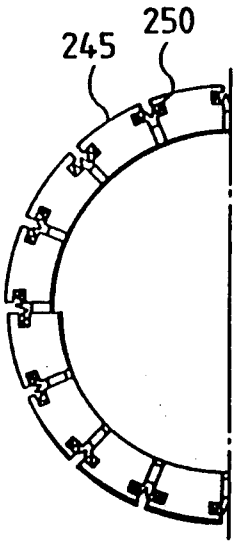
FIG. 9*a* is a front view of a portion of the device illustrated for example in FIG. 9.
Figure 11:
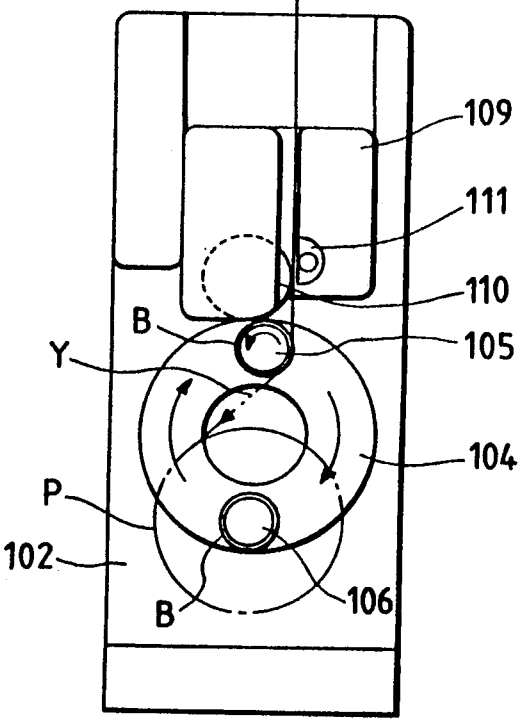
FIG. 11 PRIOR ART
FIG. 11 is a front view of a conventional spun yarn winding machine.
Figure 10:
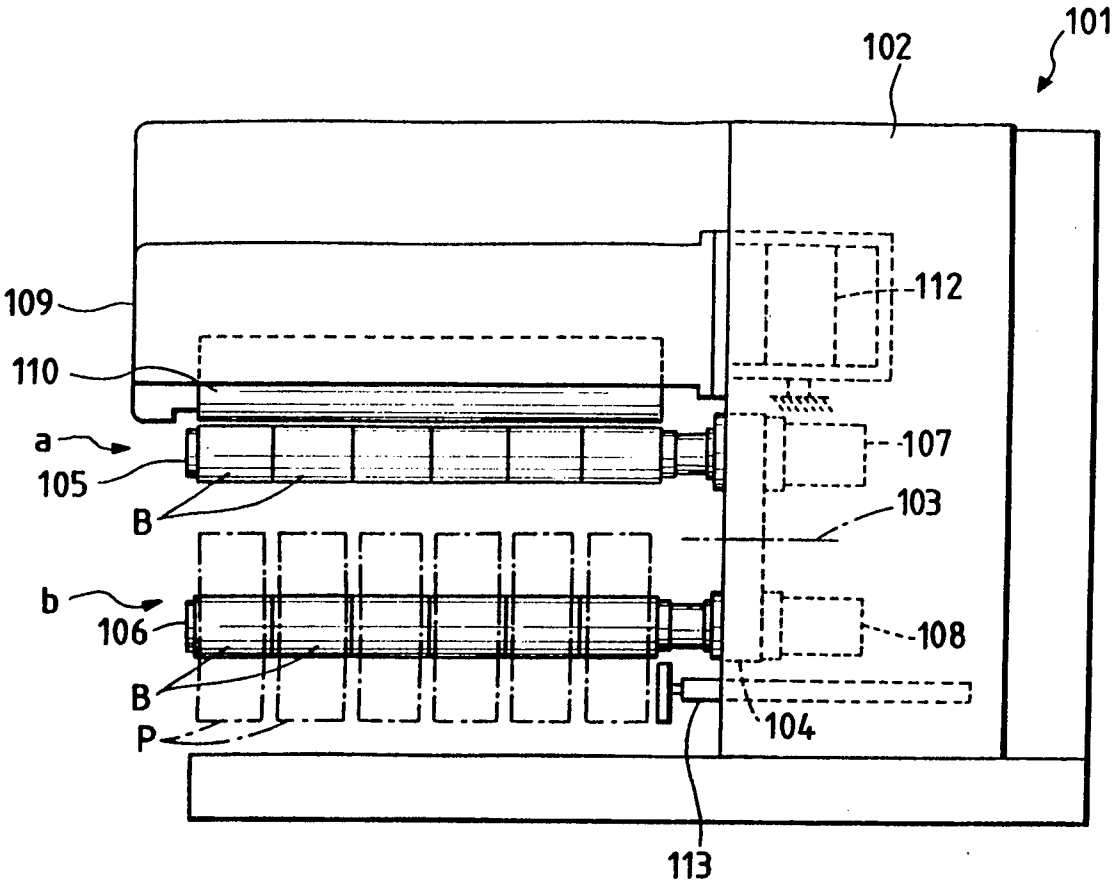
FIG. 10 PRIOR ART
FIG. 10 is a sectional view of a conventional spun yarn winding machine.

The construction and operation of one embodiment of the chuck device 218 at the root portion of the bobbin holder 206 will be described hereinafter with reference to FIGS. 9 and 9*a*. The upper side portions of FIGS. 9 and 9*a* show the open state, and the lower portion show the chucking state. The chuck device 218 has an expansible circumferential split ring 245 for externally grasping an outer diameter portion of the bobbin holder 206. That is, in the case where a full package is removed from the bobbin holder 206, the bobbin holder 206 is in a cantilever state as described in FIG. 12. Therefore, an excessively large load acts on the bearing, and therefore, the root of the bobbin holder 206 is grasped by the chuck device 218 to relieve the load on the bearing within the bobbin holder 206.

The chuck device 218 may include a cylinder 246 attached to the turret plate 204, a piston 247 and a split ring 245. The cylinder 246 and the piston 247 form a first air chamber 248 and a second air chamber 249. A port f is opened to the first air chamber 208, and a port g is opened to the second air chamber 249. The piston 247 has an inclined inner diameter portion 247*a* which engages an inclined outer diameter portion 245*a* of the split ring 245. The split ring 245 is urged in a direction of enlarging. a diameter by means of a spring 250 and is maintained in close contact with the inclined inner diameter portion 247*a* of the piston 247. The split ring 245 is guided to the extreme end 246*a* of the cylinder 246.

The operation of the previously described embodiment of the chuck device 218 will be described hereinbelow. First, the open state will be described. When pressurized air is introduced from the port g into the second air chamber 249, the piston 247 moves leftward in the figure. The split ring 456 which tends to be enlarged in diameter by the spring 250 is positioned in the inner part of the inclined inner diameter portion 247*a*, and the inner diameter portion 245*b* of the split ring 245 is positioned away from the bobbin holder 206. Next, the chucking state will be described. When pressurized air is introduced from the port f into the first air chamber 248, the piston 247 moves rightward in the figure. The split ring 245 overcomes the bias of the spring 250 and the split ring 245 reduces in diameter to assume a position in the vicinity of the extreme end of the inclined inner diameter portion 247*a*. The bobbin holder 206 is grasped by the inner diameter portion 245*b* of the split ring 245.

While the above-described embodiments, a so-called spindle drive type spun yarn winding machine in which the bobbin holders 205 and 206 having the bobbin B mounted thereof are directly driven by the induction motors 207 and 208 has been described, it is to be noted that the embodiments may be applied to a so-called friction drive type spun yarn winding machine in which a touch roller in rolling contact with the bobbin B mounted on the bobbin holder is driven to thereby indirectly drive the bobbin B.

A spun yarn winding machine according to the second embodiment of the present invention may include an extreme end support device for supporting extreme ends of the bobbin holders at the winding position and at the standby position and may be capable of opening the extreme end of the bobbin holder at the standby position, and expansible chuck means for grasping a root outer diameter portion of the bobbin holder at the standby position. The double-support state is maintained except the case where the bobbin holder stayed at the standby position by the extreme end support device is removed from the package, and when the package is removed, two-point support of the bobbin holder is maintain by the chuck device for grasping the root outer diameter portion of the bobbin holder in place of the extreme end support device. Therefore, the bobbin holder is double-supported or supported at two points not only during the high speed operation but when the package is removed, making it possible to lengthen the bobbin holders.

In a spun yarn winding machine according to the another embodiment of the present invention, both left and right ends of the elevating frame which holds the touch roller is movably supported in vertical direction by the slide devices. The double-supported state is maintained by the extreme end support device except the case where the bobbin holder stayed at the standby position and the packages are removed from the bobbin holder and the touch roller and the bobbin holder are so supported as to be parallel by supporting the both ends of the elevating frame at both ends thereof. Thus, the bobbin holder is double-supported at two points during the high speed operation so that the bobbin holders can be made to be longer. Furthermore, the touch roller and the bobbin holder are maintained to be parallel and a predetermined contact pressure may be applied to a package through the touch roller.

What is claimed is:

1. A winding machine, comprising:

a first bobbin holder defining a first end and a second end, a second bobbin holder defining a first end and a second end, a rotatable turret plate supporting the respective first ends of the first and second bobbin holders and, whereby the rotatable turret plate rotates the bobbin holders between a winding area and a standby area, a first arm supporting the respective second ends of the first and second bobbin holders, and a second arm rotatably supporting the first arm, the second arm being pivotable about the winding area.

2. A winding machine as defined in claim 1, wherein the rotatable turret plate defines an axis of rotation and the first arm defines an axis of rotation coaxial with the axis of rotation of the turret plate.

3. A winding machine as defined in claim 1, wherein the first arm defines a center portion and first and second ends, the center portion of the first arm including a bearing box, the first end of the first arm including a first piston and a first cylinder, the first piston rotatably supporting a support shaft engagable with the first bobbin holder, and the second end of the first arm including a second piston and a second cylinder, the second piston rotatably supporting a support shaft engagable with the second bobbin holder.

4. A winding machine as defined in claim 3, wherein the second arm defines first and second ends, the first end of the second arm including a first shaft operably connected to the bearing box of the first arm such that the first arm is rotatably supported by the second arm, and the second end of the second arm including a third piston and a third cylinder, the third piston being engagable with one of the first and second cylinders.

5. A winding machine as defined in claim 4, further comprising:

a frame supporting the rotatable turret plate and the second arm, the frame including a rack, the second arm including a pinion, wherein the rack and pinion pivot the second arm.

6. A winding machine, comprising:

a rotatable turret plate;

a first bobbin holder defining a first end and a second end, the first end of the first bobbin holder operably connected to the turret plate, the second end of the first bobbin holder defining an opening, a second bobbin holder defining a first end and a second end, the first end of the second bobbin holder operably connected to the turret plate, the second end of the second bobbin holder defining an opening, and end support means for supporting the second ends of the first and second bobbin holders, the end support means including a first expandable chuck for engaging the opening of one of the first and second bobbin holders, and a second expandable chuck for engaging the opening of the other o the first and second bobbin holders.

7. A winding machine as defined in claim 6, wherein the end support means includes a first arm arranged coaxially with the turret plate, the first arm supporting the first and second expandable chucks, and a second arm supporting the first arm, the second arm being pivotable about a winding area.

8. A winding machine as defined in claim 7, wherein at least one of the first and second chucks comprises a cylinder, a double-action piston arranged substantially within the cylinder, a single-action piston having a shaft and a cone, the single-action piston arranged substantially within the double-action piston, and an expandable divisional ring for engaging the opening of one of the bobbin holders in response to movement of the single-action piston.

9. A winding machine as defined in claim 7, wherein the second arm includes a stop member, the stop member including a piston and a roller supported on the piston, and at least one of the chucks includes a receiving plate, the receiving plate defining a semicircular groove which receives the roller when the at least one chuck is in the winding area.

10. A winding machine as defined in claim 6, wherein each of the first and second bobbin holders define an outer portion, the winding machine further comprising:

at least one expandable chuck operably connected to the turret plate for engaging the outer portion of one of the bobbin holders.

11. A winding machine as defined in claim 10, wherein the at least one expandable chuck operably connected to the turret plate includes a cylinder attached to the turret plate, a piston and a split ring.

12. A winding machine as defined in claim 6, further comprising:

an elevating frame defining first and second ends, the elevating frame supporting a touch roller for applying a constant pressure to packages supported by one of the bobbin holders, and first and second slide devices for respectively supporting the first and second ends of the elevating frame such that a predetermined pressure is applied to the packages.

* * * * *